United States Patent [19]

Shine

[11] 4,045,078

[45] Aug. 30, 1977

[54] TILTING THERAPEUTIC TABLE

[75] Inventor: Alfred C. Shine, North Hollywood, Calif.

[73] Assignee: Daniel J. Clinton, Hollywood, Calif.

[21] Appl. No.: 734,024

[22] Filed: Oct. 20, 1976

[51] Int. Cl.[2] ..... A61G 13/00

[52] U.S. Cl. ..... 269/324

[58] Field of Search ..... 269/322–324; 5/62; 250/439, 445, 446, 447

[56] References Cited

U.S. PATENT DOCUMENTS

| | | | |
|---|---|---|---|
| 3,329,423 | 7/1967 | Kleinman | 269/324 |
| 3,609,779 | 10/1971 | Oja et al. | 269/323 |
| 3,640,520 | 2/1972 | Wieland et al. | 269/323 |

*Primary Examiner*—Al Lawrence Smith
*Assistant Examiner*—Robert C. Watson
*Attorney, Agent, or Firm*—Marvin E. Jacobs

[57] ABSTRACT

Table is moved from a near-vertical position to a horizontal position by a screw-type jack driven by an electric motor swingably mounted on a base member by a plate which also carries the jack assembly. The table includes an adjustable spreadable head rest and a foot rest. The foot rest supports the patient when the table is in its near-vertical position and may be swung to a depending position when the table is in its horizontal position. Interlock switches automatically stop the table in its near-vertical and horizontal positions. Another interlock switch takes the motor out of play when the foot rest is in its depending position with the table in its horizontal position so that the foot rest must be moved to a patient-supporting position before the table can be moved from its horizontal position to its near-vertical position.

6 Claims, 7 Drawing Figures

Fig. 1
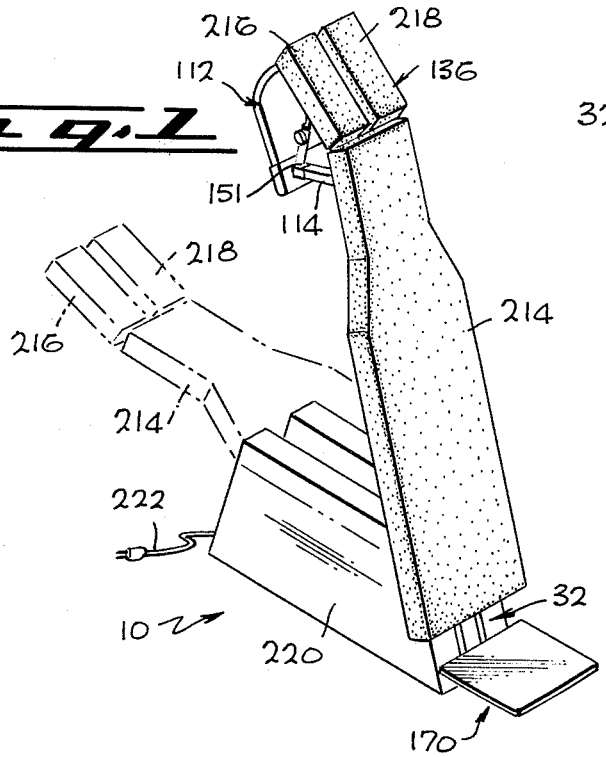
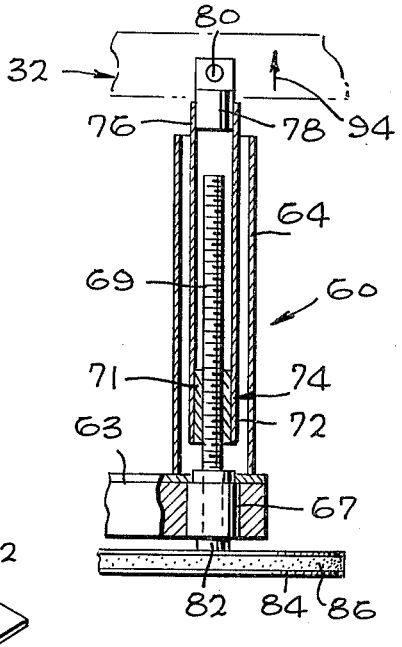
Fig. 6
Fig. 4
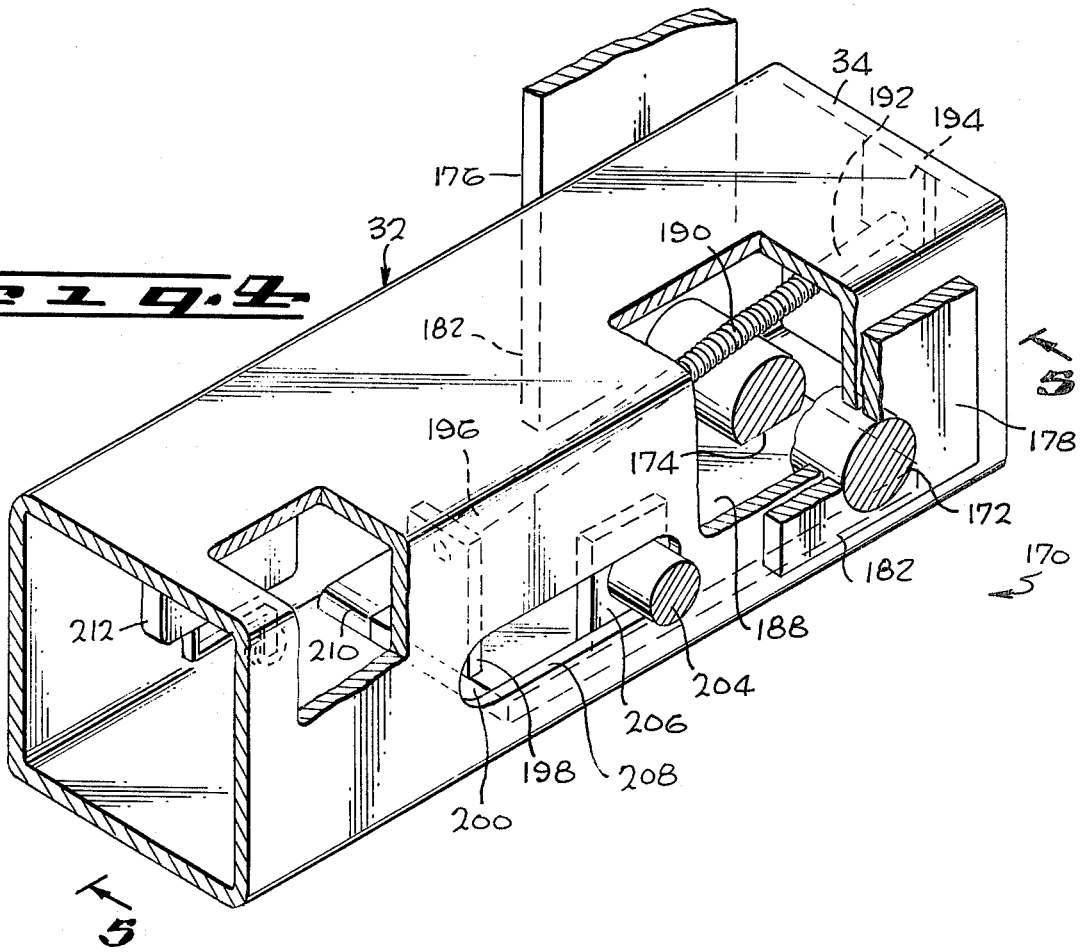

TILTING THERAPEUTIC TABLE

BACKGROUND OF THE INVENTION

1. Field of the Invention

The present invention relates to an improved patient-supporting table, more particularly, to a tiltable patient-supporting table.

2. Description of Prior Art

Patient-supporting tables are devices for supporting a patient while being worked upon or examined by a doctor. Some tables, like those used by chiropractors, may be tilted to a near-vertical position so that a patient may lean against the table while in a standing position and then be moved to a substantially horizontal position by lowering the table to its horizontal position.

Such patient-supporting tables usually employ adjustable head rests and foot rests. They also employ expensive electric motors, pumps and hydraulic cylinders to move the table from one position to another and to adjust the head rests and foot rests.

SUMMARY OF THE INVENTION

A new and useful tiltable patient-supporting table has been provided. The table includes a unique screw-jack assembly which moves the table from a horizontal to a near-vertical position efficiently and economically.

The table also includes a fully-adjustable, spreadable head piece and an improved foot rest. A locking mechanism is provided for locking the foot rest in a substantially upright, patient-supporting position when the patient is standing in front of the table when it is in its near-vertical position. The locking mechanism may be released so that the foot rest may be moved to a depending position when the table is in its horizontal position. The locking mechanism will then be held against a limit switch provided in the circuit to the electric motor so that the table cannot be moved from its horizontal position to its near-vertical position while the foot rest is in its depending position where it would not only damage the floor supporting the table, but would also permit the patient to slide off the foot of the table, should the table be moved to its near-vertical position without first moving the foot rest to its patient-supporting, locked position.

The table may comprise a base member having first and second ends and an intermediate portion, a plate swingably connected to the intermediate portion of the base member, an electric motor affixed to one side of the plate, a screw-jack assembly affixed to the other side of the plate for actuation by the electric motor, a table support affixed to one end of the base member, an elongated tubular member swingably mounted on the table support, a device pivotably connecting the upper end of the screw-jack assembly to the tubular member, a foot rest swingably connected to one end of the tubular member and a head rest swingably connected to the other end of the tubular member.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like referenced characters refer to like elements in the several views.

BRIEF DESCRIPTION OF THE DRAWINGS

FIG. 1 is a perspective view of a tiltable patient-supporting table constituting a presently-preferred embodiment of the invention showing the table in a near-vertical position in solid lines and in a horizontal position in broken lines;

FIG. 4 is an enlarged, partial perspective view, with parts broken away to show internal construction, of the locking mechanism for locking the foot rest of the table of FIG. 1;

FIG. 6 is a vertical cross-sectional view of the screw-jack assembly of the table of FIG. 1.

DESCRIPTION OF THE PREFERRED EMBODIMENT

Figure 2:
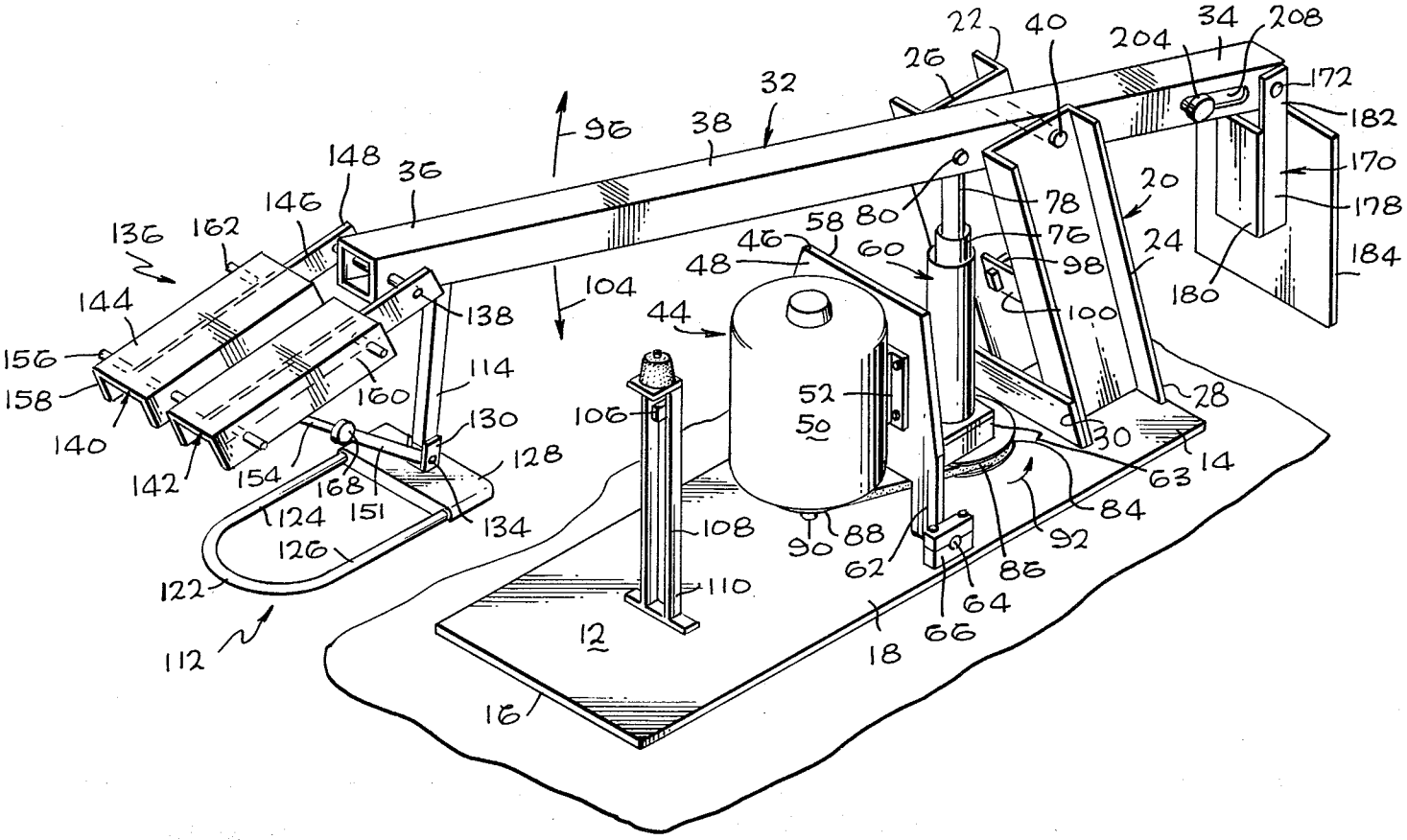
FIG. 2 is an enlarged perspective view of the table of FIG. 1 with its housing and cushions removed to show internal construction.
Figures 3, 5, 5A:
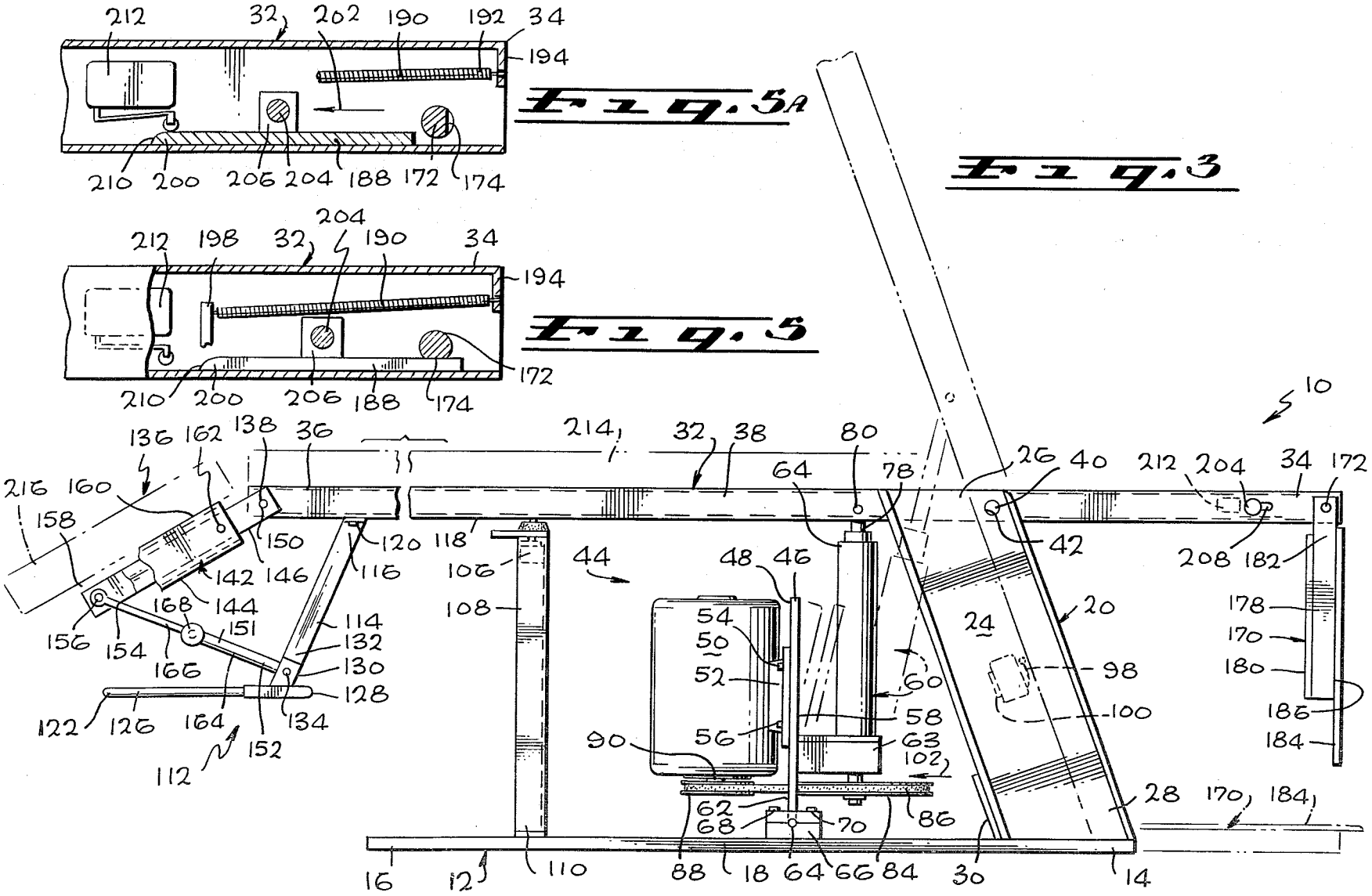
FIG. 3 is an enlarged, side-elevational view of the table of FIG. 1.
FIG. 5 is a partial, cross-sectional view taken along line 5—5 of FIG. 4.
FIG. 5A is a view similar to FIG. 5, but with the locking mechanism in an unlocked position.

Referring again to the drawings, and more particularly to FIGS. 2 and 3, a tiltable patient-supporting table constituting a presently-preferred embodiment of the invention, generally designated 10, includes a generally rectangular base member 12 having a first end 14, a second end 16 and an intermediate portion 18.

Table 10 also includes a table-supporting member 20 comprising a pair of channel members 22, 24 each having an upper end 26 and a lower end 28. The lower ends 28 are tied together with a bar 30 and are affixed to the first end 14 of base member 12 in a manner such that the channel members 22, 24 assume the near-vertical position shown in FIG. 3.

Table 10 also includes a tubular member 32 having a first end 34, a second end 36 and an intermediate portion 38. Tubular member 32 is swingably connected to support 20 by a pivot pin 40 passing through tubular member 32 between its intermediate portion 38 and its first end 34 and having its ends seated in suitable apertures, like the one shown at 42, provided in the upper end 26 of each channel member 22, 24. Tubular member 32 may be swung from the horizontal position shown in solid lines in FIG. 3 to the near-vertical position shown in broken lines by a table-moving apparatus 44 swingably connected to base member 12.

Table-moving apparatus 44 includes a plate 46 having a first side 48, to which an electric motor 50 is affixed by a bracket 52 and a pair of bolts 54, 56, and a second side 58, to which a screw-jack assembly 60 is affixed. Plate 46 also has a lower end 62 from which a pair of wrist pins, like the one shown at 64, extend. Each wrist pin 64 is journalled in a bearing block 66 affixed to base member 12 by a pair of cap screws 68, 70. Wrist pins 64 permit the table-moving apparatus 44 to move from the position shown in solid lines in FIG. 3 to the position shown in broken lines when tubular member 32 is moved to its near-vertical position. Screw-jack assembly 60 is affixed to plate 46 by a bearing block 63 to which a stationary, hollow post 64 is affixed. As best seen in FIG. 6, a bearing 67 is mounted in bearing block 63 and rotatably receives a drive screw 69 threadedly engaging a drive nut 71 carried by the lower end 72 of a vertically-movable cylinder 74 having an upper end 76 which carries a plug 78 pivotably connected to tubular member 32 by a pivot pin 80. Drive screw 69 includes a lower end 82 to which a drive sheave or pulley 84 is affixed. A drive belt 86 connects pulley 84 to a pulley 88 (FIGS. 2 and 3) carried by the output shaft 90 on motor 50 so that motor 50 will rotate drive screw 69 in a clockwise direction, as indicated by arrow 92 in FIG. 2. This drives cylinder 76 upwardly, as indicated by arrow 94 in FIG. 6. Tubular member 32 is then swung upwardly along an arcuate path, as indicated by arrow 96 in FIG. 2. When tubular member 32 reaches the near-vertical position shown in broken lines in FIG. 3, tubular member 32 engages a limit switch 98 which is affixed to support 20 by a bracket 100. Limit switch 98 deenergizes motor 50 which may then be reversed so that drive screw 69 will rotate in a counter clockwise direction, as indicated by arrow 102 in FIG. 3, lowering cylinder 74 and moving tubular member 32 downwardly in the direction of arrow 104 (FIG. 2) until tubular member 32 reaches a substantially horizontal position where it engages a second limit switch 106 to again deenergize motor 50. Limit switch 106 is carried at a suitable elevation above base member 12 by a post 108 having its lower end 110 affixed to base member 12.

Referring now to FIGS. 1, 2 and 3, table 10 also includes a hand-grip assembly 112 which is affixed to end 36 of tubular member 32 by a depending post 114 having its upper end 116 affixed to the underside 118 of tubular member 32 by a bolt 120 (FIG. 3). Hand-grip assembly 112 includes a substantially U-shaped member 122 having the open end of its arms 124, 126 engaged in a plate 128 which carries an upstanding U-shaped bracket 130 to which the lower end 132 of post 114 is connected by a bolt 134 which may be tightened to hold member 122 in selected positions, like the position shown in FIG. 3. The arms 124, 126 may be grasped by a patient lying on table 10.

Table 10 also includes a fully-adjustable, spreadable head piece assembly 136 swingably connected to end 36 of tubular member 32 by a shaft 138. Head piece 136 includes a pair of head rests 140, 142 each comprising a channel 144 affixed to an arm 146 having a free end 148 provided with an aperture 150 for mounting arm 146 on shaft 138. Head piece assembly 136 includes an adjustable arm 151 having a first end 152 affixed to the lower end 132 of post 114 and a second end 154 pivotably connected tc a rod 156 on which the front end 158 of each head rest 140, 142 is slidably mounted. The rear end 160 of each head rest is also slidably mounted on a rod 162 so that each head rest 140, 142 may be moved on rods 156, 162 from an abutting position to a separated position. Adjusting arm 151 includes a hollow cylindrical member 164 in which a rod 166 is telescopically mounted. Rod 166 may be maintained in adjusted positions by knob 168.

Referring now to FIGS. 2, 3 and 4, table 10 also includes a foot rest assembly 170 swingably connected to end 34 of tubular member 32 by a shaft 172 having a flat side formed by a land 174 (FIGS. 4, 5 and 5A). Foot rest assembly 170 includes a pair of arms 176, 178 affixed to a plate 180 and having their free ends 182 affixed to shaft 172. Foot rest assembly 170 also includes a foot plate 184 affixed to the upper surface 186 of arms 176, 178. Foot rest assembly 170 may be swung 180° from the depending position shown in FIGS. 2 and 3 to the patient-receiving position shown in solid lines in FIG. 1 and in broken lines in FIG. 3. In this position, a latch plate 188 (FIG. 4) is pulled under land 174 by a spring 190 having a first end 192 connected to a bracket 194 affixed to end 34 of tubular member 32 and a second end 196 affixed to a bracket 198 carried by the front end 200 of latch plate 188. This locks foot rest assembly 170 in its FIG. 1 position so that a patient may step on to foot plate 184 and lean against table 10 while gripping hand-grip assembly 112 during movement of tubular member 32 from its near-vertical position to its horizontal position. Foot rest assembly 170 may then be swung to its FIG. 2 position by pulling latch plate 188 forward in the direction of arrow 202 (FIG. 5A). This may be accomplished by grasping a slide knob 204 (FIGS. 4, 5 and 5A) affixed to latch plate 188 by a bracket 206. Latch plate 188 is slidably mounted in tubular member 32 with slide knob 204 extending to the outside thereof through an elongated slot 208 provided therein (FIGS. 2, 3 and 4). Latch plate 188 is provided with a camming surface 210 (FIGS. 4, 5 and 5A) which engages a limit switch 212 for taking motor 50 out of its electrical circuit when foot rest assembly 170 is in the depending position shown in FIGS. 2 and 3 so that tubular member 32 cannot be moved to its near-vertical position until foot rest assembly 170 is swung to its locked, upright patient-supporting position.

Referring now to FIGS. 1 and 3, tubular member 32 may be fitted with a suitable patient-supporting pad 214 and head piece assembly 136 may be fitted with pads 216, 218. Additionally, a suitable housing assembly 220 (FIG. 1) may be provided for covering base member 12, table-moving apparatus 44 and support assembly 20. Motor 50 may be connected to a suitable source of electricity by an electric cord 222 (FIG. 1).

Operation of table 10 is believed to be apparent and is briefly summarized at this point. As best seen in solid lines in FIG. 3, tubular member 32 is in a horizontal position so that limit switch 106 is closed and limit switch 100 is open so that motor 50 can only rotate screw-jack assembly 60 in such a manner that tubular member 32 will be elevated to its near-vertical position. However, motor 50 can not yet be energized because limit switch 212 is closed by latch plate 188. This means that it will be necessary to swing foot rest assembly 170 to its upright position permitting spring 190 to pull latch plate 188 into position beneath land 174 and lock foot rest assembly 170 in its upright position. Motor 50 may then be energized to elevate tubular member 32 to its near-vertical position whereupon a patient may stand on foot plate 184 and lean against pad 214 while gripping hand-grip assembly 112.

When tubular member 32 is in its near-vertical position, limit switch 100 is closed and limit switch 106 is open. Thus, when motor 50 is energized, tubular member 32 will swing to its horizontal position. Head piece assembly 136 may then be adjusted to support the patient's head in a suitable position and slide knob 204 may be pulled to release foot rest assembly 170 so that it may swing to its depending position giving the doctor better access to the patient.

As will be apparent to those skilled in the art, a number of different materials may be used for fabricating the various components making up the table 10. For example, all of the structural components may be fabricated from suitable steel members and the pads 214, 216 and 218 may be made from suitable plastic foam cores covered with vinyl.

While the particular tiltable patient-supporting table herein shown and described in detail is fully capable of attaining the objects and providing the advantages herein before stated, it is to be understood that it is merely illustrative of the presently preferred embodiment of the invention and that no limitation is intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

I claim:

1. A tiltable table, comprising:

a base member having first and second ends and an intermediate portion;

a plate having an upper end and a lower end, said lower end of said plate being provided with a pair of wrist pins;

a bearing block swingably connecting each of said wrist pins to said intermediate portion of said base member;

an electric motor affixed to one side of said plate, said motor having an output shaft;

a screw-jack assembly including a vertically-movable cylinder having an upper end and a lower end, a drive nut affixed to said lower end of said cylinder, a drive screw having one end threadedly engaging said drive nut to reciprocate said cylinder and another end drivingly connected to said motor output shaft and a screw bearing block rotatably receiving said another end of said drive screw;

means affixing said screw bearing block to the other side of said plate;

a table support including a pair of channel members each having an upper end and a lower end;

means affixing the lower end of each channel member to said one end of said base member for maintaining said channel members in spaced-apart, near-vertical positions;

a one-piece, elongated tubular member having first and second ends and an intermediate portion;

a pivot pin swingably connecting the portion of said tubular member which lies between its first end and its intermediate portion to said table support between said upper ends of said channel members;

means pivotably connecting said upper end of said cylinder to said tubular member between said pivot pin and said intermediate portion for swinging said tubular member from a horizontal plane to a near-vertical plane;

a foot rest swingably connected to said first end of said tubular member; and a head rest swingably connected to said second end of said tubular member.

2. A tiltable table as stated in claim 1 including pads affixed to said tubular member, said foot rest and said head rest.

3. A tiltable table as stated in claim 1 including a first limit switch for automatically stopping said tubular member when it reaches said horizontal plane, a second limit switch for automatically stopping said tubular member when it reaches said near-vertical plane and a third limit switch for deenergizing said electric motor when said foot rest is swung to a depending position with respect to said tubular member when it is in its horizontal plane.

4. A tiltable table as stated in claim 1 including:

a shaft rotatably mounted in said first end of said tubular member, said shaft being provided with a land located within said tubular member and having its ends extending to positions outside said tubular member;

a latch plate slidably mounted in said first end of said tubular member, said latch plate having a first end adapted to be pulled under said land when said shaft is in a first rotated position to prevent rotation of said shaft and being adapted to stop against said shaft when said land is rotated away from said first position;

a spring connected to said latch plate and to said tubular member for biasing said latch plate toward said shaft;

a knob attached to said latch plate for pulling it away from said land; and a limit switch mounted in said tubular member adjacent the end of said latch plate which is remote from said shaft for engagement by said latch plate when it is slid out from under said land, whereby said motor is deenergized, said foot rest including a pair of arms each having an end affixed to one of the exposed ends of said shaft and a foot plate affixed to the upper surface of said arms, said foot rest being related to the rotated position of said shaft such that said latch plate will be drawn under said land only when said foot rest is in a patient-receiving position.

5. A tiltable table as stated in claim 1 including a hand grip assembly affixed to said second end of said tubular member beneath said head rest.

6. A tiltable table as stated in claim 1 wherein said head rest comprises:

a pair of arms swingably connected to said second end of said tubular member; and a head piece slidably mounted on each arm for movement from abutting positions to separated positions.

* * * * *